US012514383B2

(12) United States Patent
Cianetti et al.

(10) Patent No.: US 12,514,383 B2
(45) Date of Patent: Jan. 6, 2026

(54) PRACTICAL SYSTEM FOR SUPPORTING AND MOVING PANELS OF A DISPLAY CABINET FOR SHOWCASING AND SELLING PRODUCTS

(71) Applicant: NEM USA INC., Brooklyn, NY (US)

(72) Inventors: Leonardo Cianetti, Gorizia (IT); Alessandro Cianetti, Gorizia (IT)

(73) Assignee: NEM USA INC., Brooklyn, NY (US)

( * ) Notice: Subject to any disclaimer, the term of this patent is extended or adjusted under 35 U.S.C. 154(b) by 216 days.

(21) Appl. No.: 18/377,400

(22) Filed: Oct. 6, 2023

(65) Prior Publication Data

US 2025/0113928 A1 Apr. 10, 2025

(51) Int. Cl.
*A47F 3/00* (2006.01)
*A47F 3/04* (2006.01)

(52) U.S. Cl.
CPC ..... *A47F 3/004* (2013.01); *A47F 3/043* (2013.01)

(58) Field of Classification Search
CPC ..... A47F 3/004; A47F 3/007; A47F 3/043; A47F 2003/008
USPC ..... 312/138.1, 139.1
See application file for complete search history.

(56) References Cited

U.S. PATENT DOCUMENTS

| | | | | |
|---|---|---|---|---|
| 6,758,539 | B2 * | 7/2004 | Cianetti | E05D 15/34 312/139.2 |
| 7,780,249 | B2 * | 8/2010 | Cianetti | A47F 3/007 312/137 |
| 2016/0000236 | A1 * | 1/2016 | Goppion | E05D 15/56 312/138.1 |

FOREIGN PATENT DOCUMENTS

| | | |
|---|---|---|
| EP | 1293153 B1 | 1/2006 |
| EP | 1843681 B1 | 7/2008 |

* cited by examiner

*Primary Examiner* — James O Hansen
(74) *Attorney, Agent, or Firm* — Oliff PLC

(57) ABSTRACT

The present invention relates to a system for moving panels of a display cabinet or counter for showcasing and selling food and non-food products. In particular, the invention relates to a system which allows the horizontal movement of adjacent panels without interference, irrespective of the shape of the panels.

9 Claims, 8 Drawing Sheets

PRACTICAL SYSTEM FOR SUPPORTING AND MOVING PANELS OF A DISPLAY CABINET FOR SHOWCASING AND SELLING PRODUCTS

TECHNICAL FIELD OF THE INVENTION

The present invention relates to a system for supporting and moving panels of a display cabinet or counter for showcasing and selling food and non-food products. In particular, the invention relates to a system which allows the horizontal movement of adjacent panels without interference, irrespective of the shape of the panels.

BACKGROUND OF THE INVENTION

According to the prior art, counters and display cabinets for show-casing and selling products are always provided with glass sheets or sheets made of transparent plastic material. These display cabinets have the function of isolating the products from the external environment for a correct preservation and/or for preventing customers from touching then with the risk of contaminations, damage or theft. However, the products must be clearly visible and easily reachable, when needed, thanks to mechanisms for moving one or more sheets of said counters or display cabinets. To this end, the sheets are constrained in various ways to an upper frame supported by uprights or to a lower frame fixed to the counter or display cabinet.

Among the various systems for fixing sheets to the upper frame, some provide for lifting/rotating each sheet upwards in order to gain access into the inside of the counter, as mentioned, to replenish the goods on display or simply to clean the counter or display cabinet, sheets comprised.

Regardless of the lifting/rotating system used, each sheet must be capable of staying open in a sufficiently high position and in a stable safety position so as to be able to gain access into the counter or display cabinet without danger of the operator knocking his/her head. This is achieved by lifting the sheet upwards by rotating it using appropriately calibrated hinge systems and retaining springs. Once the goods have been loaded and/or unloaded and/or the necessary cleaning has been carried out, said sheets may be returned to their sales service position or to close the display compartment.

Though very common, these systems reveal some drawbacks. In particular, in order to support the panels there arises the need to use profiled bars having significant sections in order to avoid torsions and deformations of the frame. This entails high production costs and lesser visibility of the products displayed in the display cabinets and counters. Furthermore, the gas plungers commonly used for helping in closing and opening panels are subject to greater wear, with resulting danger of sudden closing of the panels from the maximum opening position. In any case, there always persists the risk of knocking the staff even with the panel open given that no system ensures the full overturning thereof, especially with curved panels.

In an attempt to overcome the aforementioned drawbacks, there have been proposed opening systems with lateral and horizontal movement of the panels through a quadrilateral mechanism. Such system is described for example in patent EP1293153. With this solution, many of the aforementioned problems would have been overcome. Despite this, panels with shelf or horizontal support surfaces cannot be opened with the lateral movement system given that the respective shelves or surfaces would impact it.

Patent EP1843681 partially resolves some problems of the previous solution thanks to the provision of a quadrilateral system with one shorter and one longer arm so as to allow not only the translation but also a rotation on the translation plane to increase the opening and therefore guarantee a broader accessibility to the display cabinet.

Unfortunately, even this solution does not overcome the problem related to the presence of horizontal shelves given that the rotation would cause the impact between the shelves.

SUMMARY OF THE INVENTION

Therefore, the object of the present invention is to provide a system for the multiple vertical and lateral movement of panels of a display cabinet or counter for showcasing and selling products, that solves the problems outlined above.

Therefore, a first object of the invention is a system for the multiple vertical and lateral movement of a panel or sheet of a display cabinet capable of vertically superimposing panels with horizontal shelves without the danger of impacts.

A second object is a robust and safe movement system capable of supporting panels with significant thicknesses.

A third object is a movement system which allows access into the display cabinet or counter without the danger of hits for the operator.

A further object is a movement system that is practical and easy to assemble, both provided with components that are not complex and therefore not subject to malfunctions.

BRIEF DESCRIPTION OF THE FIGURES

Advantages, characteristics and other objects of the invention will be apparent from the following description, provided by way of non-limiting example, with reference to the attached figures, wherein.

DETAILED DESCRIPTION OF THE INVENTION

Figure 1:
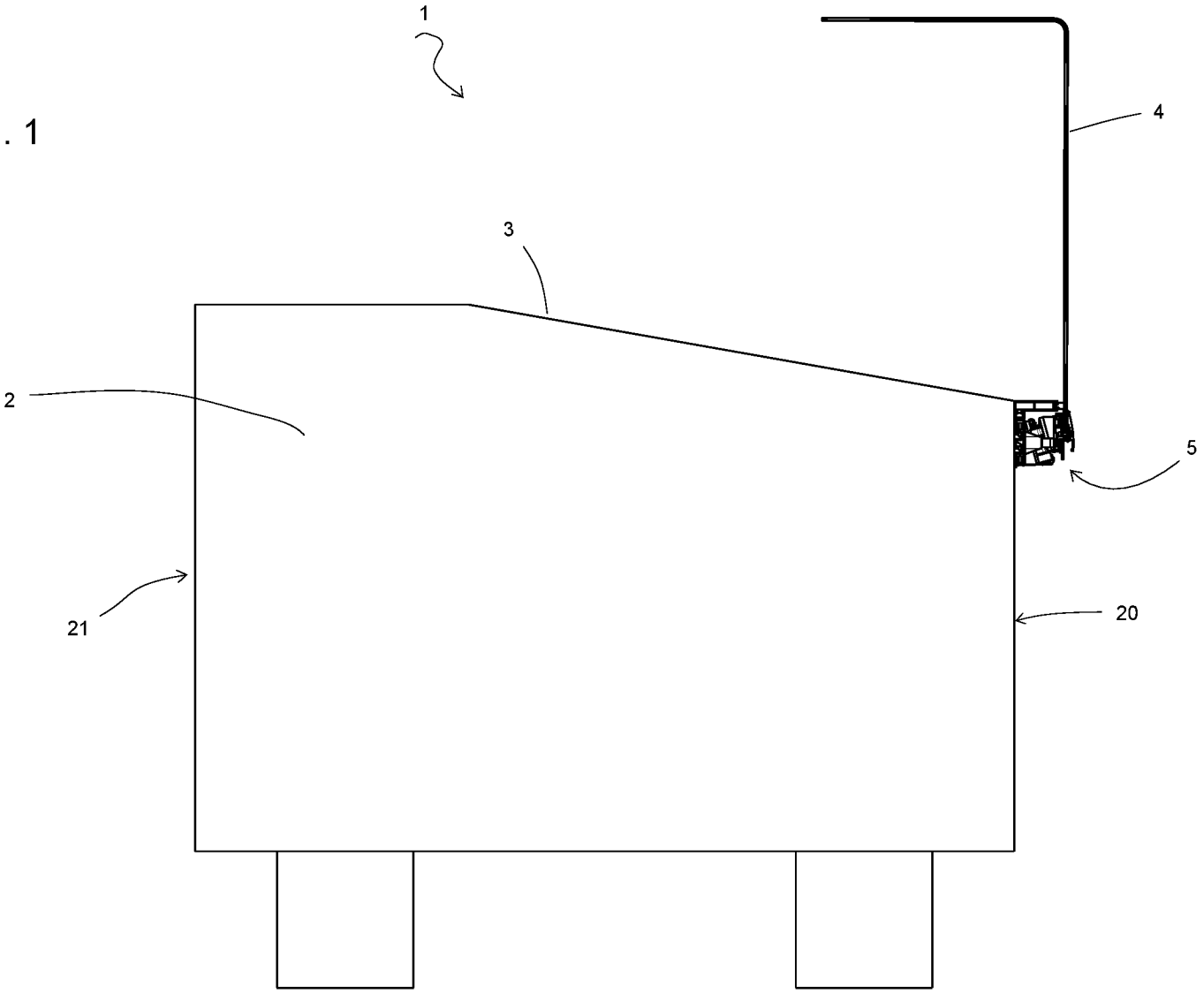
FIG. 1 shows a lateral schematic view of a display cabinet for showcasing products comprising a system for moving panels according to the present invention.

With reference to FIG. 1, a display cabinet for showcasing products according to the present invention is schematically shown and indicated with reference numeral 1. It comprises a counter 2 placed on the ground into which there are introduced products of various kind being showcased, whether foodstuffs or objects in general. The counter notoriously comprises a front side 20 facing towards the buyers, a rear side 21 facing towards the sales staff and an upper shelf 3 on which the products being showcased are placed. In order to separate the products from the buyers, partitioning panels 4 are installed on the front side 20 using suitable support and movement systems 5 capable of guaranteeing not only the support but also the horizontal movement to allow both the loading/unloading of the products on the shelf and the cleaning of the internal surface of the panels, that is the surface facing towards the sales staff.

The expressions high, low, front, rear, above, below and the like used in the following description refer to the display cabinet when in operating condition.

Figure 3:
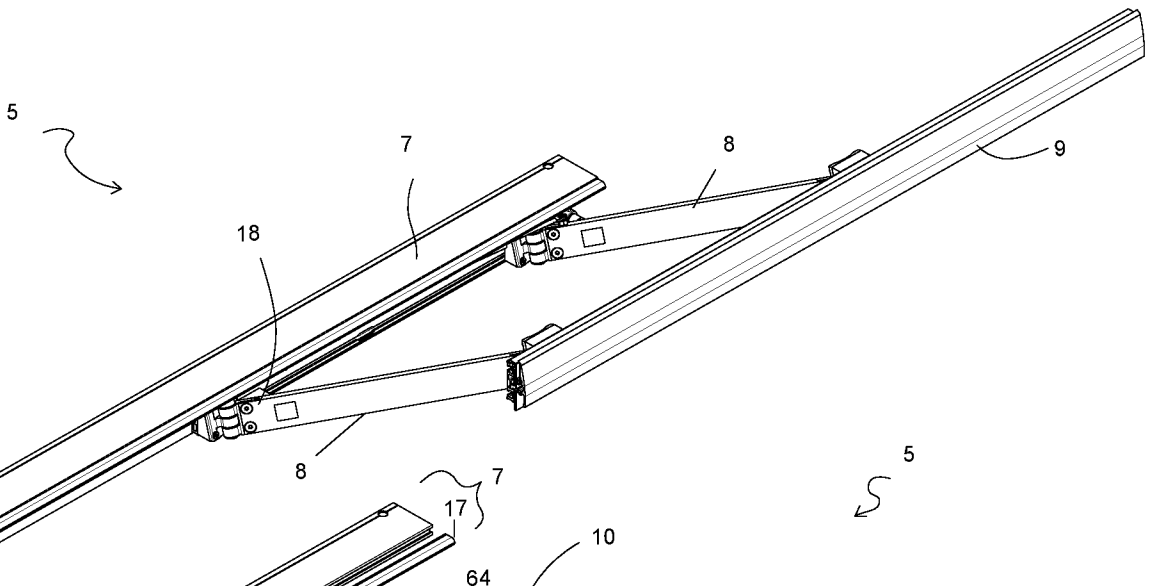
FIG. 3 shows an axonometric view of the system of FIG. 2 assembled.
Figure 2:
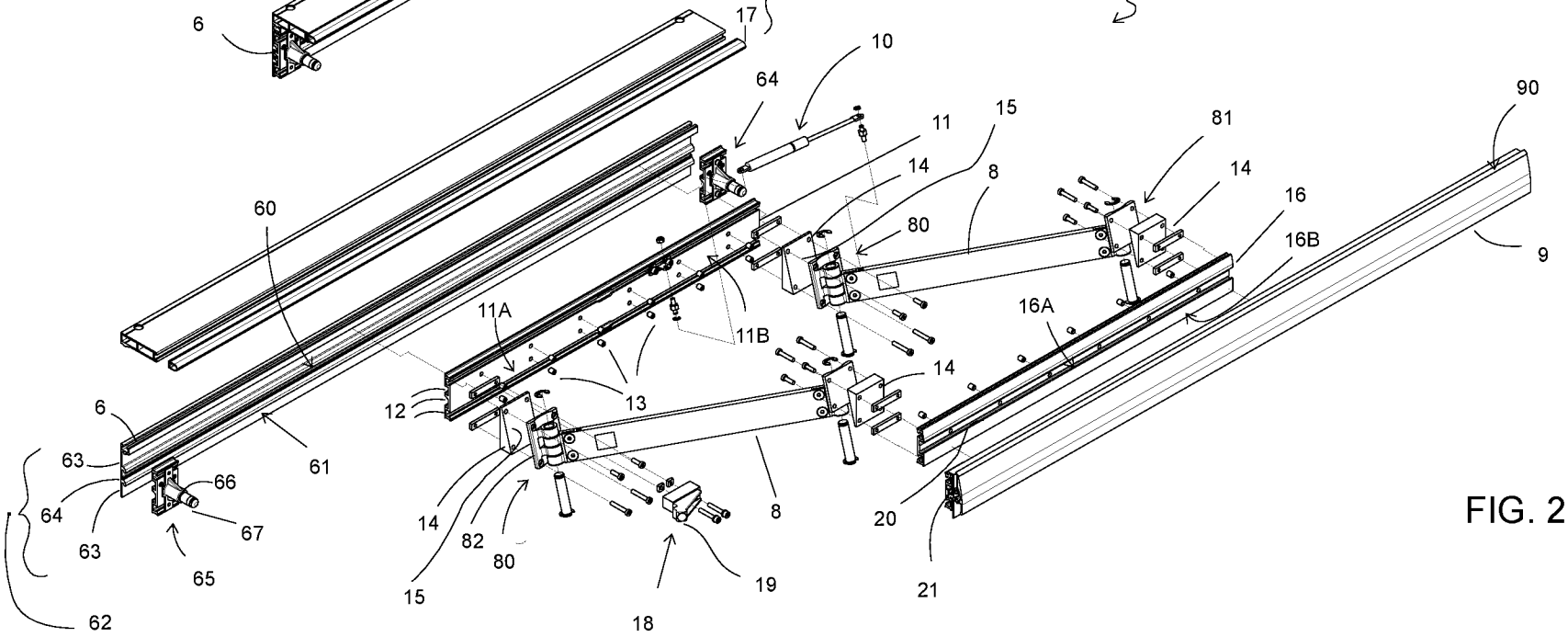
FIG. 2 shows an exploded axonometric view of the movement system of the display cabinet of FIG. 1.

As better shown in FIGS. 2 and 3, the support and movement system 5 according to the present invention is a quadrilateral system comprising a bar 6 for anchoring to the counter 2, a sideboard 7 for supporting a panel to close, two arms 8 pivoted for the movement of a panel, a section 9 for supporting said panel and a plunger 10 for aiding the opening and closing of the panel.

The bar 6 for anchoring to the counter 2 (FIG. 2) is a conventional flat straight bar provided with a first side 60 for fixing to the counter and a second side 61, opposite to the first, for fixing said arms 8. Preferably, the second side 61 is provided with first engagement means 62 adapted to cooperate with corresponding second engagement means of said arms. According to an embodiment, said first means 62 are coupling engagement means for example consisting of two parallel tracks 63 provided with an undercut, preferably separated by a longitudinal notch 64. Furthermore, the bar 6 preferably comprises a pair of dampers 65 mounted on each of its two ends for example through engagement means (not shown) complementary to those of the bar described above. Said dampers may for example comprise a protrusion 66 at whose end there is fixed a damping element 67 such as a rubber thickness.

The arms 8 are directly fixed to the bar 6 using conventional systems such as screws. Preferably, they are fixed by interposing a straight plate 11 locked on the second side 61 of the bar 6; more preferably, they are locked using second engagement means 12 complementary to the aforementioned first engagement means 62 of the bar 6 obtained on a first side 11A of the bar opposite to a second side 11B. The first 62 and the second 12 engagement means respectively of the bar 6 and of the plate 11 advantageously allow to move the mutual position regularly with precision the opening and the closing of the panels 4 even based on their different sizes. Once the bar and plate are engaged in the operative position, they may be locked using conventional fasteners such as for example screws 13.

Advantageously, according to the present invention, each arm 8 is fixed on the second side 11B of the plate 11 through an inclined-plane element 14. The inclined-plane element is in turn fixed to the plate 11 with the straight side thereof, while the inclined side 15 is faced towards the arm 8. In particular, the inclined side 15 is faced upwards, when the system is in the operative position.

Furthermore, each arm 8 comprises a first end 80 comprising a plate 82 for fixing to said inclined-plane element 14 provided with conventional slots (not indicated) adapted to be axially intervalled with corresponding slots (not indicated) of the straight portion of the arm. Said slots are notoriously rotatably constrained to each other using a pivot which simultaneously engages the relative holes of said slots forming a joint. The fixing plate 82 is locked on the inclined-plane element 14 through conventional screws.

Similarly, the second end 81 of each arm 8 is fixed to the section 9 for supporting the panel 4 in a manner similar to the one described above for the first end. Preferably, even the second end is fixed to the section using a plate 16. Furthermore, each second end 81 is identical to the first, therefore it comprises the same type of joint.

Preferably, the plate 16 has a first side 16A for fixing said inclined-plane element 14 and a second side 16B opposite to the first and provided with engagement means 20 adapted to cooperate with engagement means 21 of the section 9. These engagement means may be a longitudinal groove provided with undercuts.

Advantageously, even the second end 81 of each arm 8 is fixed to the section 9, directly or indirectly through the plate 16, using an inclined-plane element 14 identical to the one described with reference to the first end 80. In particular, the inclined side 15 is faced towards the arm 8, while the straight side is faced towards the section 9. In addition, the inclined side is faced downwards, when the system is in the operating condition. In other words, the inclined side of the second end 81 is faced towards the opposite direction with respect to that of the first end 80 so as to form complementary angles when carried on the same plane.

The section 9 is entirely conventional, therefore it will not be described herein. In particular, may comprise engagement means 21 complementary to the engagement means 20 of the plate 16, and that is they can be a longitudinal protrusion with slidable engagement parallel edges with undercuts of the plate 16. Furthermore, as known, the section is formed by a gripper-like longitudinal upper edge 90 for safely retaining a panel. This gripper-like edge may be shaped so as to mount differently shaped curved panels, as shown in the FIGS. 7A and 7B.

The sideboard 7 for supporting the panel 4, when closing on the display cabinet 1, it protrudes by 90° from the upper longitudinal edge of said bar 6 and it carries a gasket for absorbing the contact of the panel when it is closed.

Preferably, the system of the invention comprises an end-of-stroke element 18 when a panel 4 is carried in the full opening condition. Such element prevents the open panel from impacting against the panel which remains closed, as explained below, limiting the rotation angle of at least one arm 8. Preferably, as shown in FIGS. 2, 3 and 5B, such element is a block fixed close to the plate 82 of the first end 80 of the arm 8 positioned farthest from the adjacent panel and from the side between the two arms which support a panel. Furthermore, the block comprises a rubber element 19 for safely supporting the arm 8.

A plunger 10 is then conventionally mounted—with one end—to the bar 6 or to the plate 11 and—with the other end—to one of the two arms 8, preferably, as shown in the figures, to the arm closest to the closed adjacent panel and on the opposite side with respect to the space between the two arms.

A second subject of the invention is a display cabinet for showcasing and selling products comprising a counter 2 for resting on the ground provided with a surface 3 for showcasing products and adjacent partitioning panels 4 supported and moved by the system 5 described above (FIG. 1).

Figure 4:
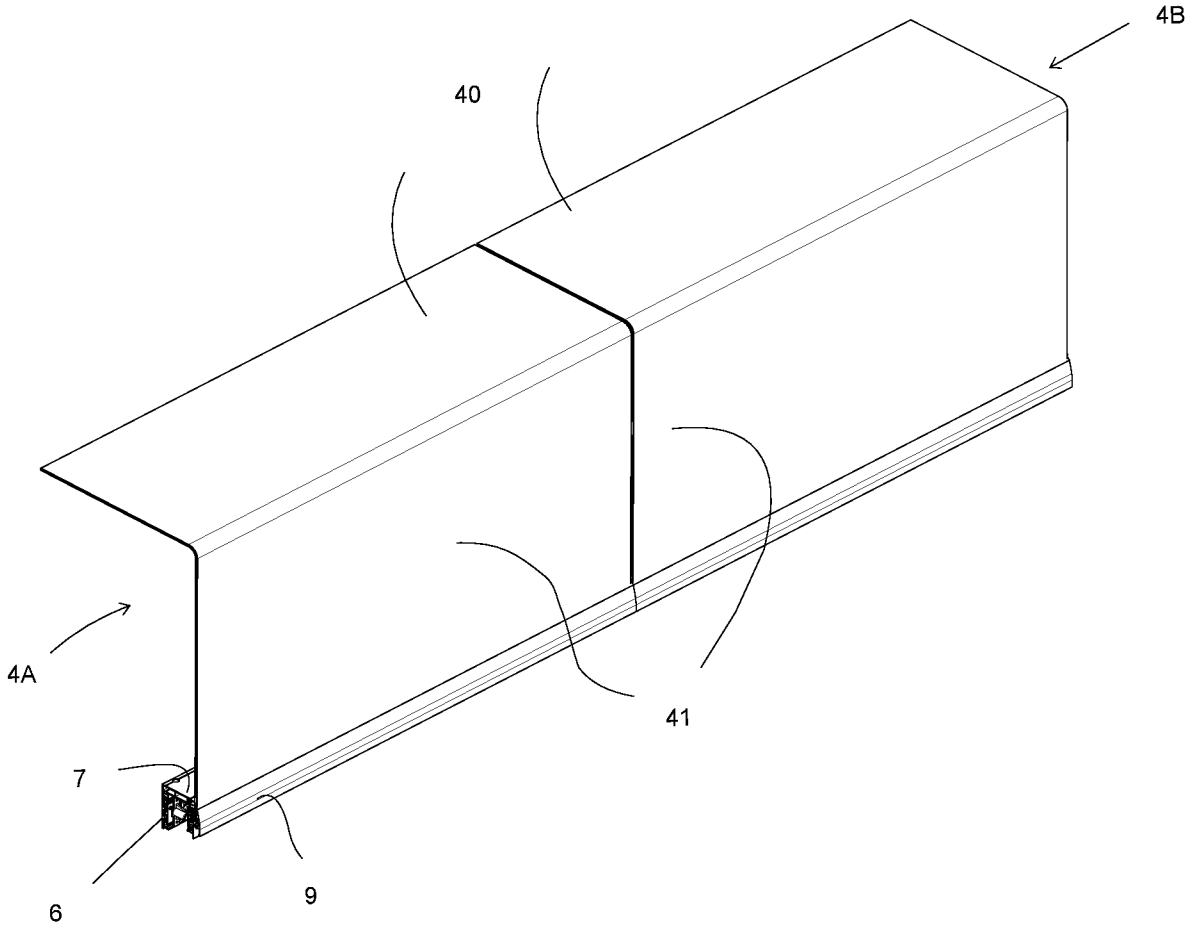
FIG. 4 shows an axonometric view of a pair of panels arranged adjacent to each other of a display cabinet for showcasing products according to the invention, in closing condition.

FIG. 4 shows two panels 4A and 4B shaped and arranged adjacent in closing condition of a display cabinet for showcasing products (not shown). In particular, the panels 4A and 4B are shaped with a horizontal portion 40 and a vertical portion 41 with respect to the support ground of the counter.

In other words, the panels 4A and 4B are formed with a single shaped sheet with two 90°-portions, but they may be connected portions with larger angles depending on the specific need. Alternatively, the panels may be two separate sheets, one vertical and one horizontal, glued together which form the shaped panel as described above.

Figure 5A:
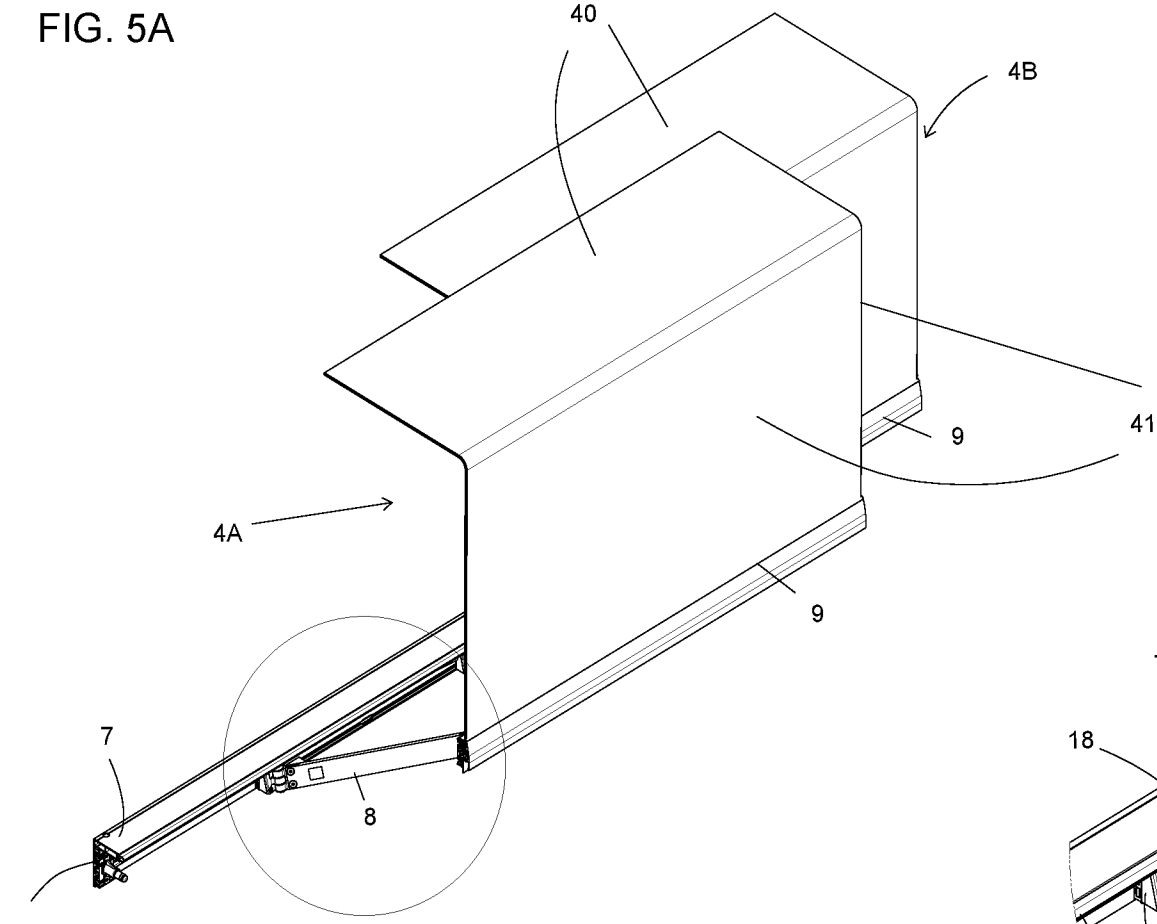
FIGS. 5A and 5B respectively show an axonometric view of the pair of panels of FIG. 4 in a partial opening position, and an enlarged view of a detail of the movement system in such condition.
Figure 5B:
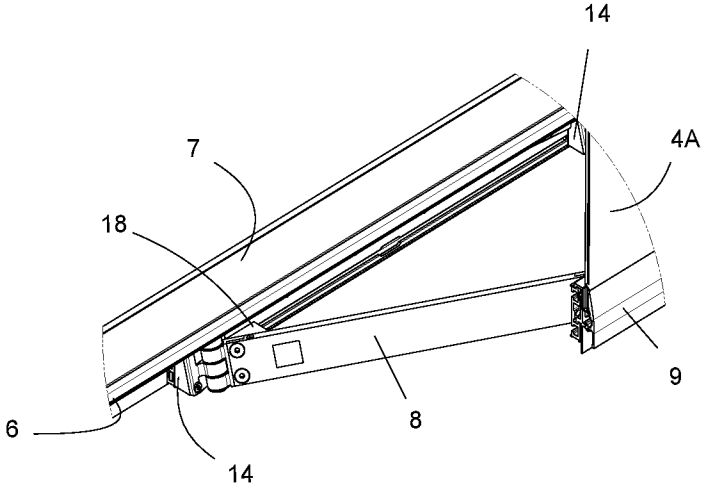
Figure 6B:
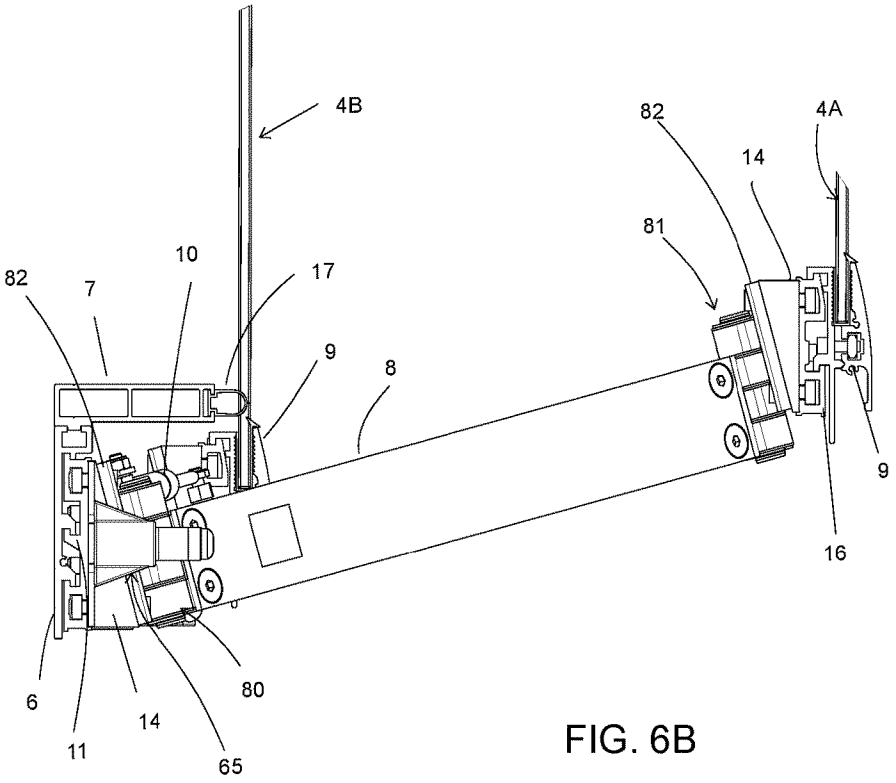
FIGS. 6A and 6B respectively show a lateral view of the panels of FIG. 5A and an enlarged view of a detail of FIG. 6A.
Figure 6A:
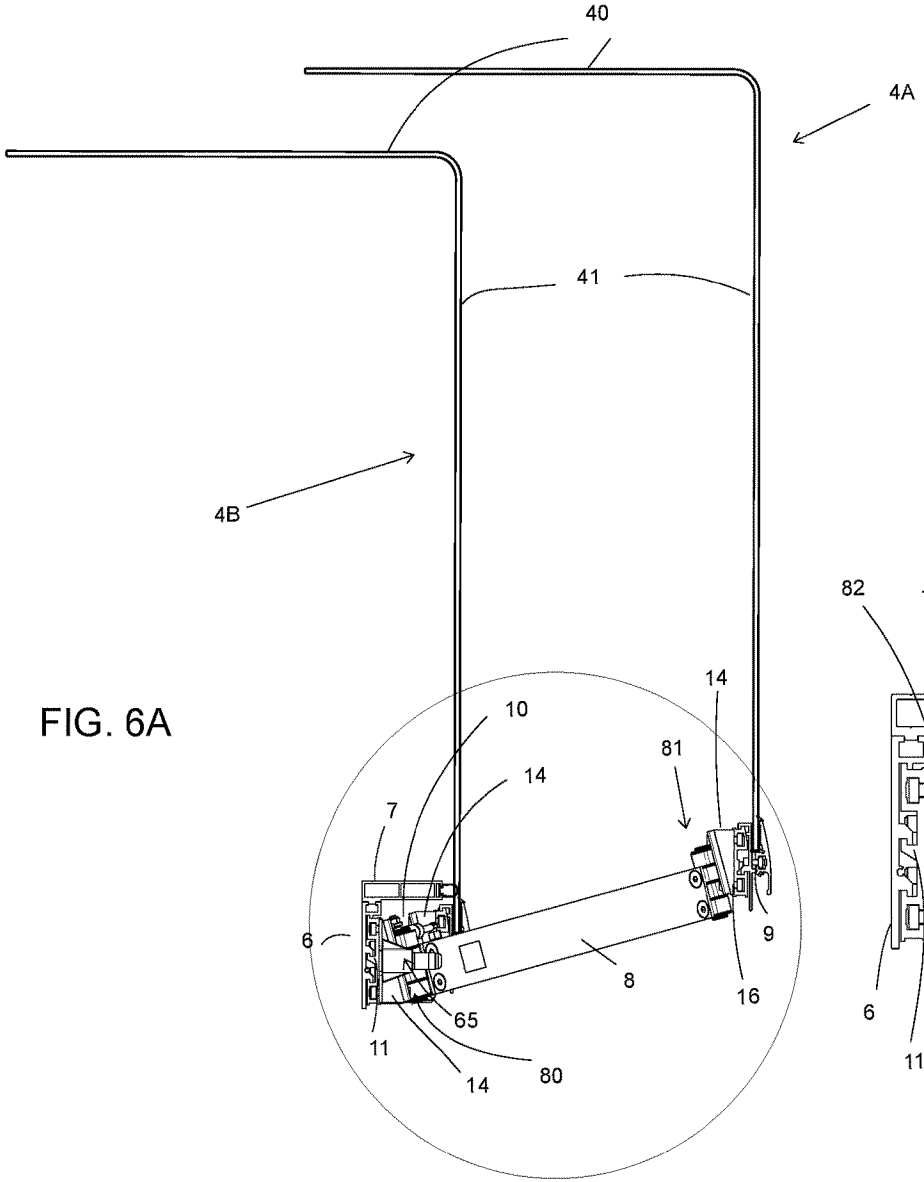

As observable from FIG. 5A, with the opening, the panel 4A is firstly raised upwards also moving away from the adjacent panel 4B. This movement is allowed by the aforementioned articulated quadrilateral structure and advantageously by the presence of the two inclined-plane element 14 thanks to which the panel 4A is raised upwards (FIG. 5B). In this manner, the horizontal portion 40 of the panel 4A is brought to an upper plane with respect to the identical portion 40 of the adjacent panel 4B. This movement is clearly shown in FIGS. 6A and 6B which show the upward inclination of an arm 8 with respect to the horizontal portion 40 of the panels 4A and 4B.

Figure 7A:
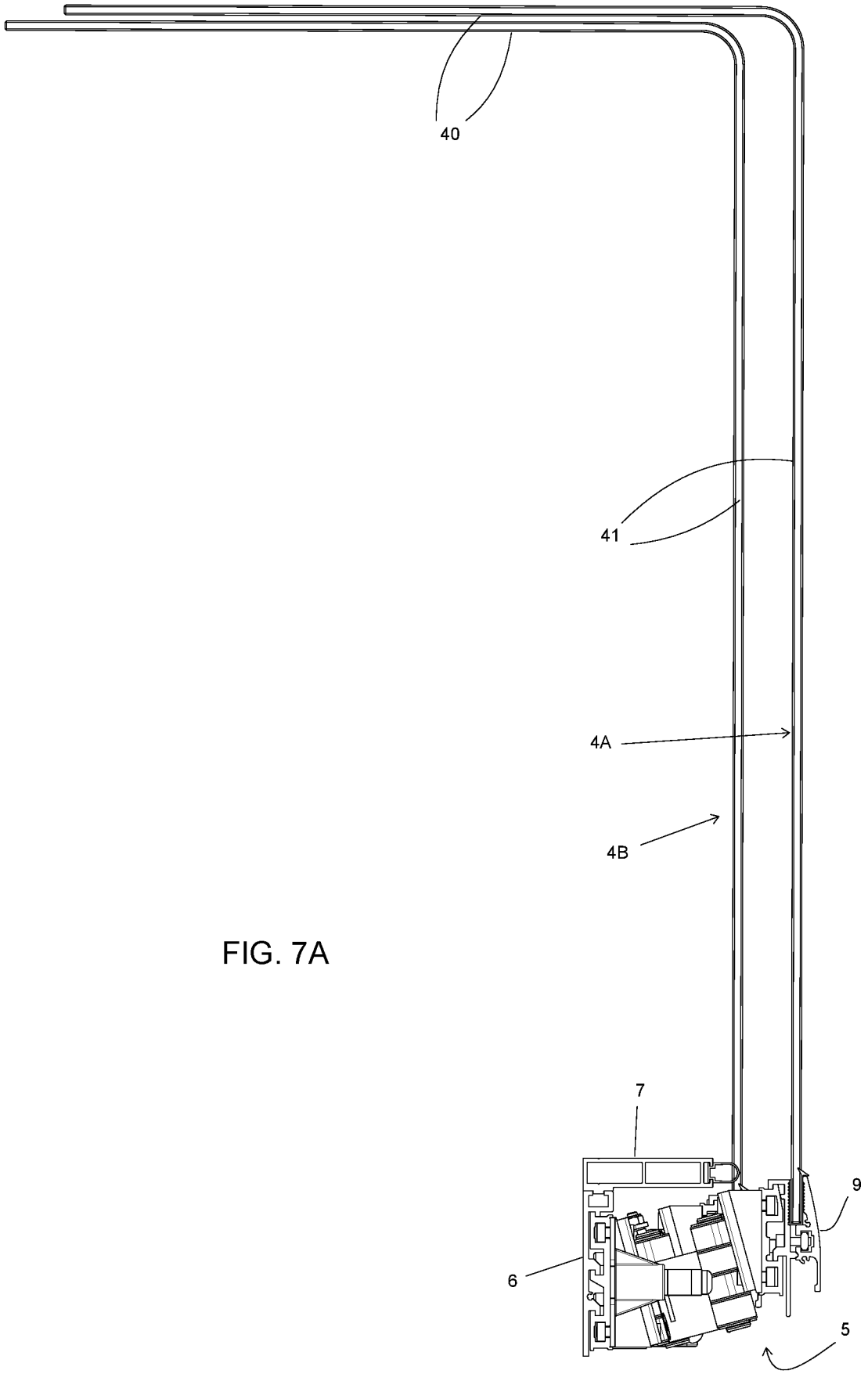
FIGS. 7A and 7B respectively show a lateral view of the panels of FIG. 6A with a panel in the full-opening condition and a similar view with panels having a different curvature between the vertical and horizontal portion.
Figure 7B:
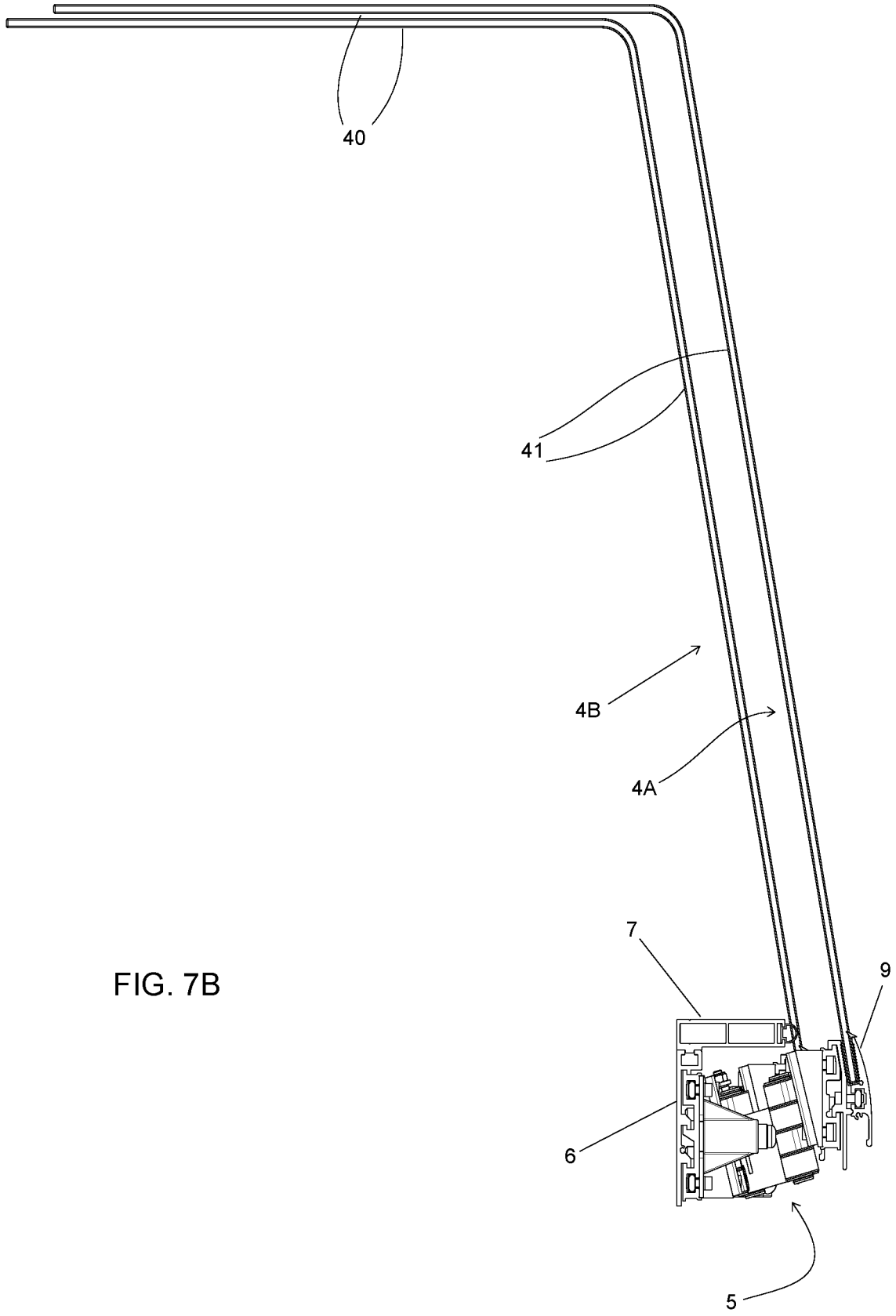

Once the panel 4A has been raised, this can be translated laterally towards the panel 4B being superimposed thereto without danger of impact. As a matter of fact, as shown in FIG. 7A, with the full opening of the panel 4A, there is obtained a superimposition of the respective horizontal 40 and vertical 41 portions of the two panels without them touching each other. Even once the angle between the two portions has been changed, as shown in FIG. 7B, and with suitable replacement of the gripper 90 of the section 9, said portions are superimposed without impacting each other.

Figure 8:
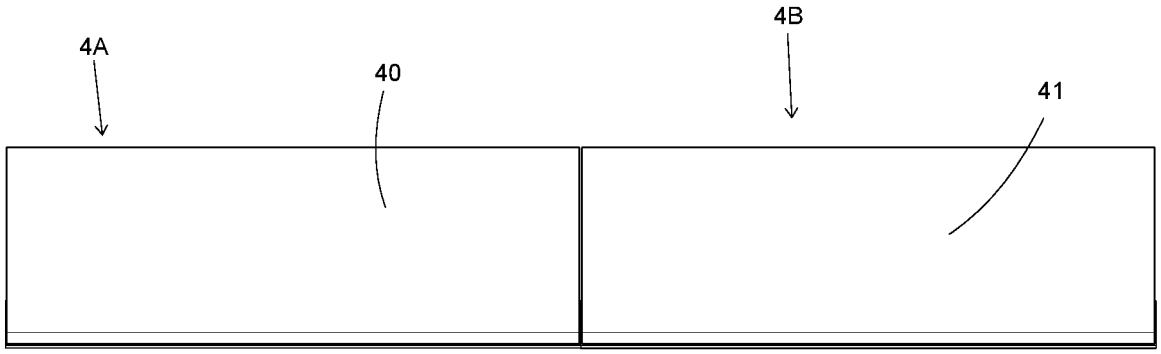
FIG. 8 shows a top view of a pair of panels of a display cabinet for showcasing products in the closing condition.
Figure 9:
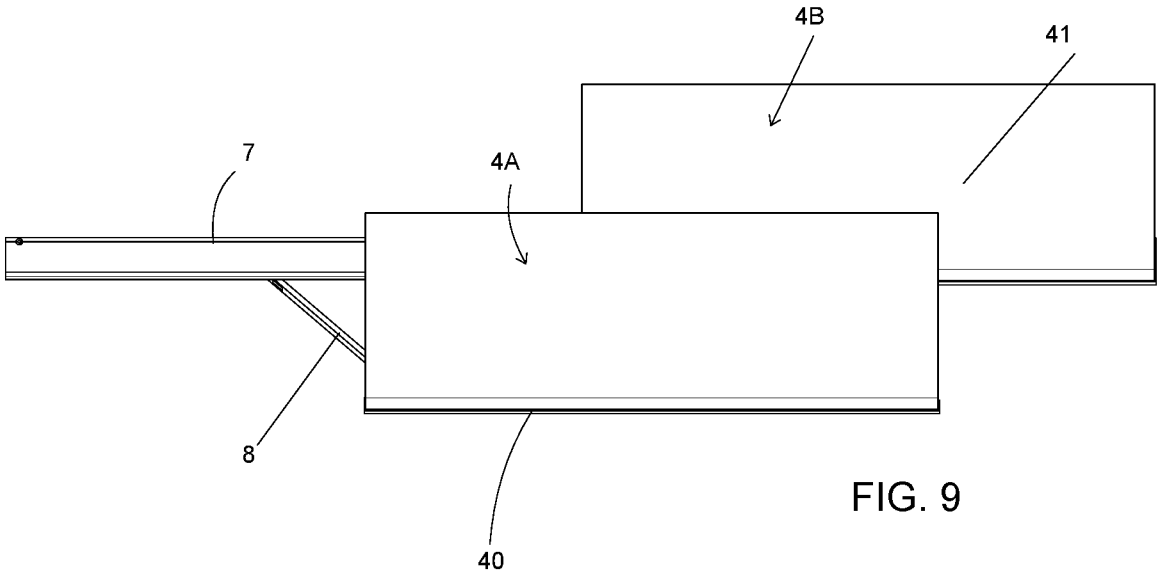
FIG. 9 shows a top view of the panels of FIG. 8 with a left panel partially open.
Figure 10:
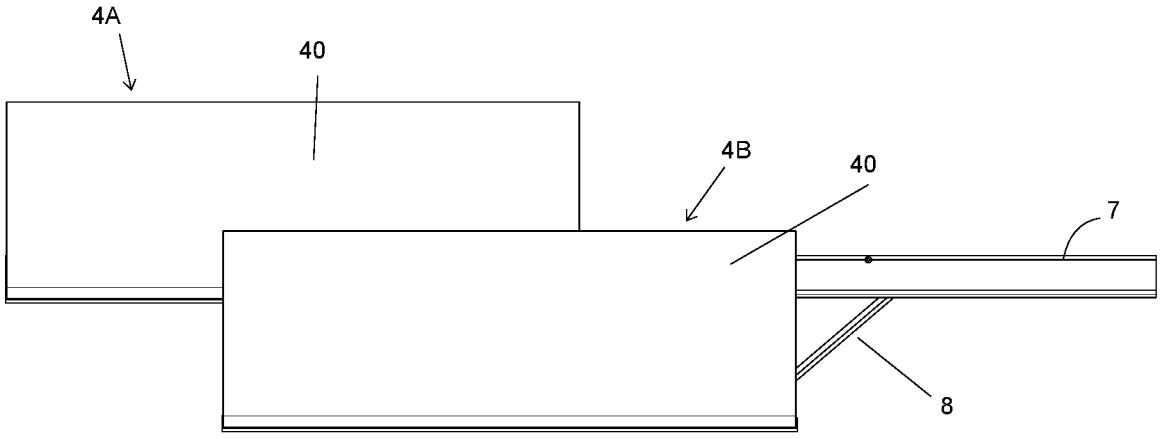
FIG. 10 shows a top view of the panels of FIG. 8 with the right panel partially open.

Furthermore, as also observable from FIGS. 8-10, looking at the panels from above it is clear that the closing position in which the panels are arranged adjacent to each other, the panel 4A can be moved on panel 4B (FIG. 9) and vice versa (FIG. 10), therefore allowing the reciprocating opening of the entire display cabinet even with the shaped panels provided with a horizontal support portion.

The arms 8 are guided by the plunger 10 (FIGS. 6A and 6B) so as to avoid sudden movements.

Furthermore, in the maximum opening condition the end-of-stroke element 18 forms a stop abutment of the rotation of the arm 8 preventing the full rotation of the arm from causing the vertical portion 41 and the horizontal portion 40 of the panels to collide against each other.

Then, each panel is closed safely thanks to the damper 64 which absorbs the contact with the section 9 and the gasket 17 which absorbs the contact with the vertical portion 41 of the panel 4.

In the light of the above, it is clear that the drawbacks of the prior art have been overcome and the significant advantages have been achieved.

As a matter of fact, the system subject of the present invention allows to also use shaped panels with a significant horizontal portion, without the danger of impacts during the opening thereof. In addition, according to the market demand, panels with frames carrying horizontal portions for supporting purchased products, frames which tend to affect the visibility of the displayed products.

The system is obtained using simple, effective and robust solutions such to facilitate the assembly, maintenance and duration over time.

Numerous changes can be implemented by the person skilled in the art, but without departing from the scope of protection of the attached claims.

For example, the described and represented shapes of each component of the system as well as of the panels may vary depending on specific needs or preferences. Even the materials used may vary. For example, glass or plastic as plexiglass may be used for the panels. The mechanical components may be made of metal such as steel and/or aluminium. The rubber that the sections, the stop elements and end-stroke elements are made of may be natural or synthetic.

There may also be provided for a spring closing mechanism, possibly combined with a closure like the ones described in the aforementioned patent EP1843681.

The invention claimed is:

1. A system for supporting and moving a quadrilateral of a panel of a display cabinet for showcasing and selling products, comprising a bar for anchoring to a counter of the display cabinet, a sideboard for supporting the panel to close, two arms with pivots for moving the panel, a section for supporting the panel, and a plunger for aiding opening of the panel, wherein each of the arms comprises a first end connected to the bar through a first inclined-plane element with a first inclined surface faced toward the section and inclined upwards, when the system is mounted on the display cabinet, and a second end connected to the section through a second inclined-plane element with a second inclined surface faced toward the bar and inclined downwards, when the system is mounted on the display cabinet, and the first inclined-plane element and the second inclined-plane element offset the pivots from a vertical orientation such that the quadrilateral raises upwards and away from the display cabinet when moving the quadrilateral.

2. The system according to claim 1, further comprising a plate interposed between the bar and the arms, the plate comprising second engagement means on a first side and adapted to cooperate with first engagement means on the bar, wherein the inclined-plane element is fixed on a second side of the plate.

3. The according to claim 2, wherein the first engagement means of the bar are couplings.

4. The system according to claim 1, further comprising a plate interposed between the second ends of the arms and the section.

5. The system according to claim 4, wherein the plate has a first side for fixing the inclined-plane element and a second side opposite to the first side and comprising engagement means adapted to cooperate with engagement means of the section.

6. The system according to claim 5, wherein the engagement means of the plate are a longitudinal groove with undercuts, and the engagement means of the section are a protrusion with slidable engagement parallel edges slidable with the undercuts.

7. The system according to claim 1, further comprising a pair of dampers mounted one on each of the ends of the bar.

8. The system according to claim 1, further comprising an end stop element fixed close to the first end of the arm positioned farthest from the panel and from the side between the two arms which support the panel.

9. An openable display cabinet for showcasing products, comprising a counter placed on the ground into which the products being showcased are introduced, the counter comprising a front side facing towards the buyers, a rear side facing towards the sales staff, an upper shelf on which the products being showcased are positioned, partitioning panels installed on the front side using movement, and the support system according to claim 1.

* * * * *